US012134883B2

(12) United States Patent
Suliman

(10) Patent No.: US 12,134,883 B2
(45) Date of Patent: Nov. 5, 2024

(54) DEVICE FOR ADDING FLUID MEDIUM TO SHOWER SYSTEM, AND SHOWER SYSTEM

(71) Applicant: Magid Abdalla Suliman, Blackrock (IE)

(72) Inventor: Magid Abdalla Suliman, Blackrock (IE)

( * ) Notice: Subject to any disclaimer, the term of this patent is extended or adjusted under 35 U.S.C. 154(b) by 797 days.

(21) Appl. No.: 17/250,803

(22) PCT Filed: Oct. 24, 2019

(86) PCT No.: PCT/CN2019/112922
§ 371 (c)(1),
(2) Date: Mar. 4, 2021

(87) PCT Pub. No.: WO2020/088335
PCT Pub. Date: May 7, 2020

(65) Prior Publication Data

US 2021/0189704 A1 Jun. 24, 2021

(30) Foreign Application Priority Data

Nov. 1, 2018 (CN) ..... 201821794448.5

(51) Int. Cl.
*E03C 1/046* (2006.01)
*A47K 3/28* (2006.01)

(52) U.S. Cl.
CPC ..... *E03C 1/046* (2013.01); *A47K 3/281* (2013.01); *E03C 2201/40* (2013.01)

(58) Field of Classification Search
CPC .... E03C 1/046; E03C 1/0465; E03C 2201/40; A47K 3/281
(Continued)

(56) References Cited

U.S. PATENT DOCUMENTS 9,022,073 B2 * 5/2015 Strauli ..... E03C 1/046 4/903
2012/0118414 A1 5/2012 McMurtry
2015/0361645 A1 * 12/2015 Bonacci ..... E03C 1/046 366/176.1

FOREIGN PATENT DOCUMENTS

CN 102918212 A 2/2013
CN 105258338 A 1/2016
(Continued)

OTHER PUBLICATIONS

International Search Report and Written Opinion in corresponding International Patent Application No. PCT/CN2019/112922 dated Jan. 22, 2020.

*Primary Examiner* — Tuan N Nguyen
(74) *Attorney, Agent, or Firm* — Westman, Champlin & Koehler, P.A.

(57) ABSTRACT

The present application relates to the technical field of shower system, and provides a device for adding a fluid medium to a shower system and a shower system. The device includes a water pipe assembly, a fluid medium pipe assembly and a valve body assembly. The valve body assembly includes a one-way valve for preventing back flow of the liquid medium and a water jet pump. The one-way valve is provided between a fluid medium inlet and a fluid medium outlet. The water jet pump includes a three-way valve pipe. A water inlet pipe of the three-way valve pipe is in communication with a water inlet, a water return pipe of the three-way valve pipe is in communication with the fluid medium outlet, and a water mixing pipe of the three-way valve pile is in communication with a water outlet.

11 Claims, 3 Drawing Sheets

(58) Field of Classification Search
USPC ..... 4/903, DIG. 10, 597, 605, 661
See application file for complete search history.

(56) References Cited

FOREIGN PATENT DOCUMENTS

| | | | | | |
|---|---|---|---|---|---|
| CN | 205224186 | U | 5/2016 | | |
| CN | 106419797 | A | 2/2017 | | |
| WO | WO-2004040071 | A1 * | 5/2004 | ..... | E03C 1/046 |

* cited by examiner

DEVICE FOR ADDING FLUID MEDIUM TO SHOWER SYSTEM, AND SHOWER SYSTEM

This Application is a Section 371 National Stage Application of International Application No. PCT/CN2019/112922, filed Oct. 24, 2019 and published as WO 2020/088335 A1 on May 7, 2020, and further claims priority to Chinese Patent Application Ser. No. 201821794448.5, filed Nov. 1, 2018.

TECHNICAL FIELD

The present application relates to the technical field of shower system, and more particularly, to a device for adding a fluid medium to a shower system, and a shower system.

BACKGROUND

The existing shower system generally includes a water heater, a shower and a water mixing valve. An inlet of the water mixing valve is connected with an outlet of the water heater, the other inlet of the water mixing valve is connected with a cold water pipe, and an outlet of the water mixing valve is connected with the shower. Hot water in the water heater is mixed with cold water in the cold water pipe in the water mixing valve, and then is transported to the shower. Modern people habitually use water from the shower system for spraying or washing, and apply shower gel or soap on the skin during the shower to help personal hygiene. For a long time, people take shower gel through directly squeezing the bottle containing the shower gel by hand, and then apply it to the skin so that it can be mixed with water from the shower system or can be used for washing, which is tedious and troublesome.

SUMMARY

Technical Problem

The present application aims to solve at least one of the technical problems existing in the prior art. As such, the present application proposes a device for adding a fluid medium to a shower system. The device for adding the fluid medium to the shower system is simple in structure, and enables a user to control the supply of the fluid medium easily and conveniently while showering.

Technical Solution

Embodiments of the present application provide a device for adding a fluid medium to a shower system. The device includes:

a water pipe assembly including a water pipe that has a water inlet and a water outlet, and the water inlet and the water outlet are configured to connect with the shower system;

a fluid medium pipe assembly including a suction pipe that has a fluid medium inlet and a fluid medium outlet, and the fluid medium outlet is connected with the water pipe assembly; and a valve body assembly including a one-way valve for preventing back flow of the liquid medium and a water jet pump, the one-way valve is provided between the fluid medium inlet and the fluid medium outlet, the water jet pump includes a three-way valve pipe, a water inlet pipe of the three-way valve pipe is in communication with the water inlet, a water return pipe of the three-way valve pipe is in communication with the fluid medium outlet, and a water mixing pipe of the three-way valve pipe is in communication with the water outlet.

To this end, when the device for adding a fluid medium to a shower system according to the embodiments of the present application is used by a user, a negative pressure is generated in the water inlet pipe of the water jet pump, thereby controlling the fluid medium to be sucked from the fluid medium inlet of the suction pipe and flow into the water return pipe of the water jet pump. The fluid medium is mixed with the water flowing into the water inlet pipe of the water jet pump in the water mixing pipe of the water jet pump, and then flows into the shower system via the water outlet to supply the fluid medium for the user. In the above operations, the fluid medium can be brought into contact with the skin of the user without directly squeezing the bottle containing the fluid medium by hand.

In some embodiments, the three-way valve pipe includes a venturi nozzle. The water inlet pipe, the water return pipe and the water mixing pipe meet at a center, and the venturi nozzle is provided between the water inlet pipe and the center.

In some embodiments, the three-way valve pipe is a venturi three-way valve pipe.

In some embodiments, the fluid medium pipe assembly includes a venturi switch. The venturi switch is provided between the fluid medium inlet and the water return pipe.

In some embodiments, the water pipe assembly includes a bypass pipe. A water inlet end of the bypass pipe is in communication with the water inlet and the water inlet pipe respectively, and a water outlet end of the bypass pipe is in communication with the water outlet and the water mixing pipe respectively.

In some embodiments, the water pipe assembly includes a flow regulator. The flow regulator is provided between the water inlet end of the bypass pipe and the water outlet end of the bypass pipe.

In some embodiments, the device includes a box body in which the fluid medium pipe assembly and the valve body assembly are disposed.

In some embodiments, a bottom of the box body is provided with a reservoir for storing the fluid medium. The suction pipe extends into the reservoir. The box body is detachably connected to the reservoir.

In some embodiments, the bottom of the box body is provided with a through hole, and the reservoir is provided with a protrusion that is plug-fitted with the through hole.

In some embodiments, the fluid medium pipe assembly includes a venturi switch. The venturi switch is connected between the fluid medium inlet and the water return pipe. The device includes a fixing plate having a first groove portion. The venturi switch includes a first activation element, and the first activation element is disposed in the first groove portion and faces a left side face or a right side face of the box body.

In some embodiments, the device further includes a bottom plate. The bottom plate is provided with a second groove portion and a third groove portion. The water pipe is disposed in the second groove portion, and the water jet pump is disposed in the third groove portion.

In some embodiments, the fluid medium includes one or more fragrance media. Or the suction pipe is a flexible pipe.

Embodiments of the present application provide a shower system. The shower system includes a showerhead and a water source connector for introducing a water. A water inlet of the showerhead is in communication with a water outlet of the water source connector. The shower system further includes the device for adding a fluid medium to the shower system as described above. The water outlet of the water source connector is further in communication with the water inlet, and the water inlet of the showerhead is further in communication with the water outlet.

According to the shower system of the embodiments of the present application, a user can control the supply of the fluid medium easily and conveniently while showering.

In some embodiments, the system further includes a four-way valve pipe having a first water inlet, a first water outlet, a second water inlet and a second water outlet. The first water inlet is in communication with the water outlet of the water source connector, the first water outlet is in communication with the water inlet, the second water inlet is in communication with the water outlet, and the second water outlet is in communication with the water inlet of the showerhead.

Beneficial Effect

The additional aspects and advantages of the present application will be partly given in the following description, and some of the additional aspects and advantages will become obvious from the following description, or be understood through the practice of the present application.

BRIEF DESCRIPTION OF THE DRAWINGS

In order to illustrate technical solutions provided in embodiments of the present application or in the prior art more clearly, the disclosure will be further elaborated with the drawings for illustrating the embodiments or the prior art. It is apparent that the drawings in the following descriptions only show some embodiments of the present application. Other drawings may further be obtained by those of ordinary skill in the art according to these drawings without creative work.

Figure 1:
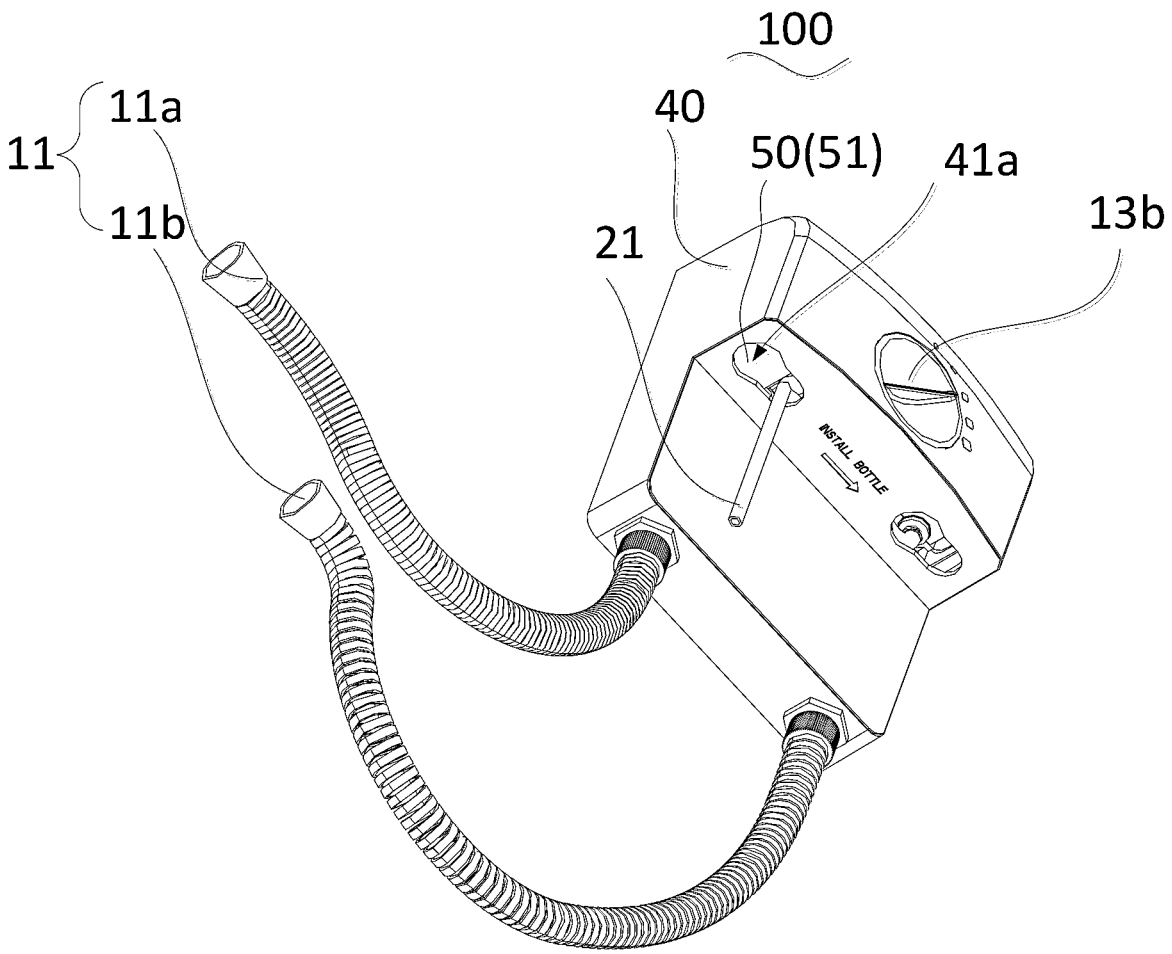
FIG. 1 is a perspective view of a device for adding a fluid medium to a shower system according to an embodiment of the present application.

LIST OF REFERENCE SYMBOLS device 100 for adding a fluid medium to a shower system, water pipe assembly 10, water pipe 11, water inlet 11*a*, water outlet 11*b*, bypass pipe 12, water inlet end 12*a*, water outlet end 12*b*, flow regulator 13, second activation element 13*a*, second rotary knob 13*b*, fluid medium pipe assembly 20, suction pipe 21, fluid medium inlet 21*a*, fluid medium outlet 21*b*, venturi switch 22, first activation element 22*a*, first rotary knob 22*b*, valve body assembly 30, water jet pump 31, water inlet pipe 31*a*, water return pipe 31*b*, water mixing pipe 31*c*, one-way valve 32, box body 40, box cover 41, through hole 41*a*, box bottom 42, reservoir 50, protrusion 51, fixing plate 60, first groove portion 61, bottom plate 70, second groove portion 71, third groove portion 72.

The implementations of the purposes, functional characteristics, and advantages of the present application will be further described in conjunction with the embodiments and with reference to the drawings.

DETAILED DESCRIPTION

The embodiments of the present application will be described in detail below. Examples of the embodiments are shown in the drawings in which the same or similar reference symbols represent the same or similar elements or elements with the same or similar functions. It is to be understood that the embodiments described below with reference to the drawings are exemplary, and are merely intended to illustrate the present application, but are not be intended to limit the present application.

The following description provides many different embodiments or examples for implementing different structures of the present application. In order to simplify the disclosure of the present application, the components and arrangements of the specific examples are described below. Of course, they are only exemplary and are not intended to limit the present application. In addition, reference symbols and/or letters may be repeated in the various examples of the present application. This repetition is for the purpose of simplicity and clarity and does not indicate a relationship between the various embodiments and/or arrangements discussed. Furthermore, various specific processes and materials are provided in the present application, but it is known for those of ordinary skill in the art that other processes and/or other materials may be used.

Figure 2:
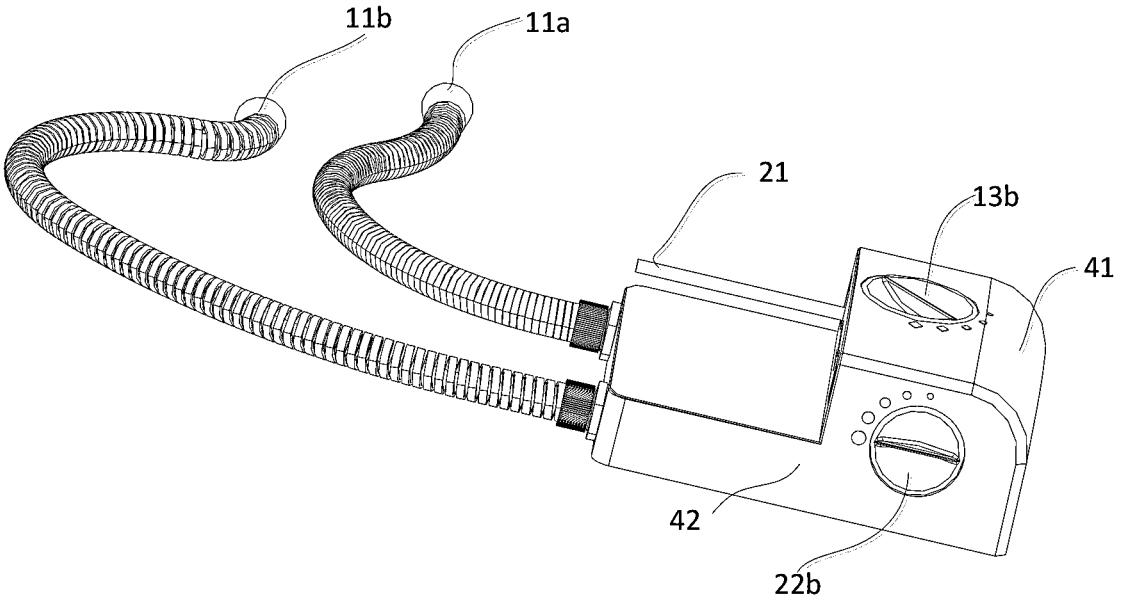
FIG. 2 is a perspective view of the embodiment shown in FIG. 1 from another perspective.
Figure 3:
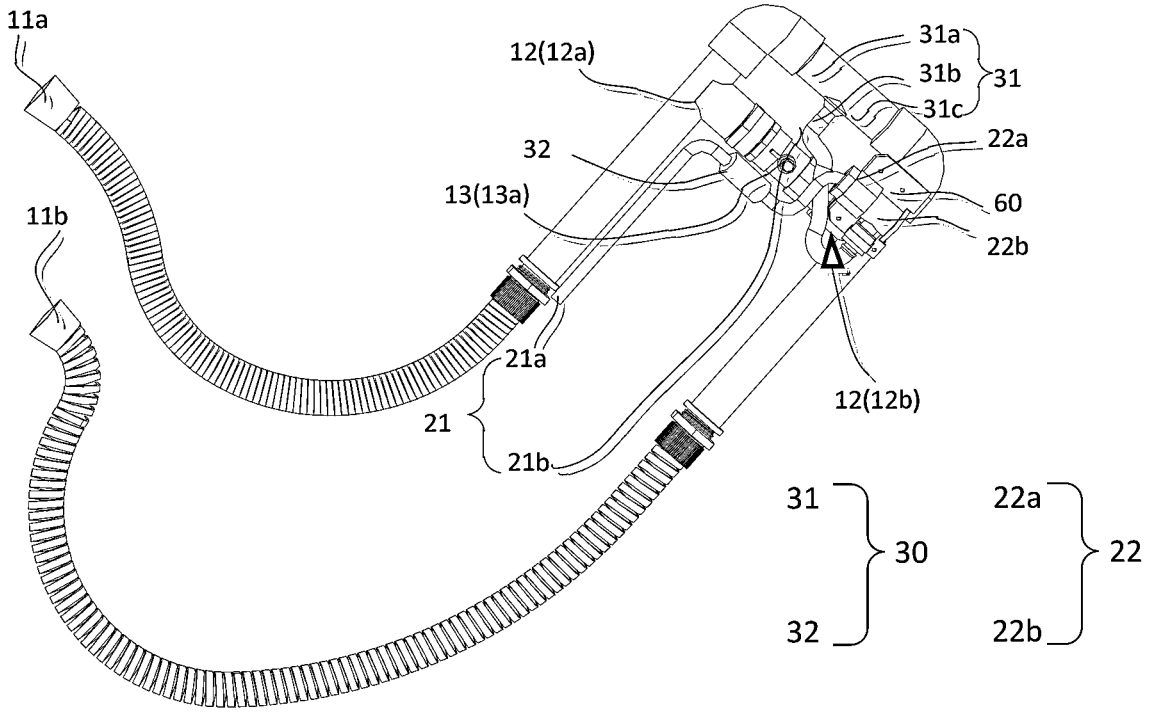
FIG. 3 is a perspective view of the connection of the pipe assembly and the valve body assembly of the embodiment shown in FIG. 1.
Figure 4:
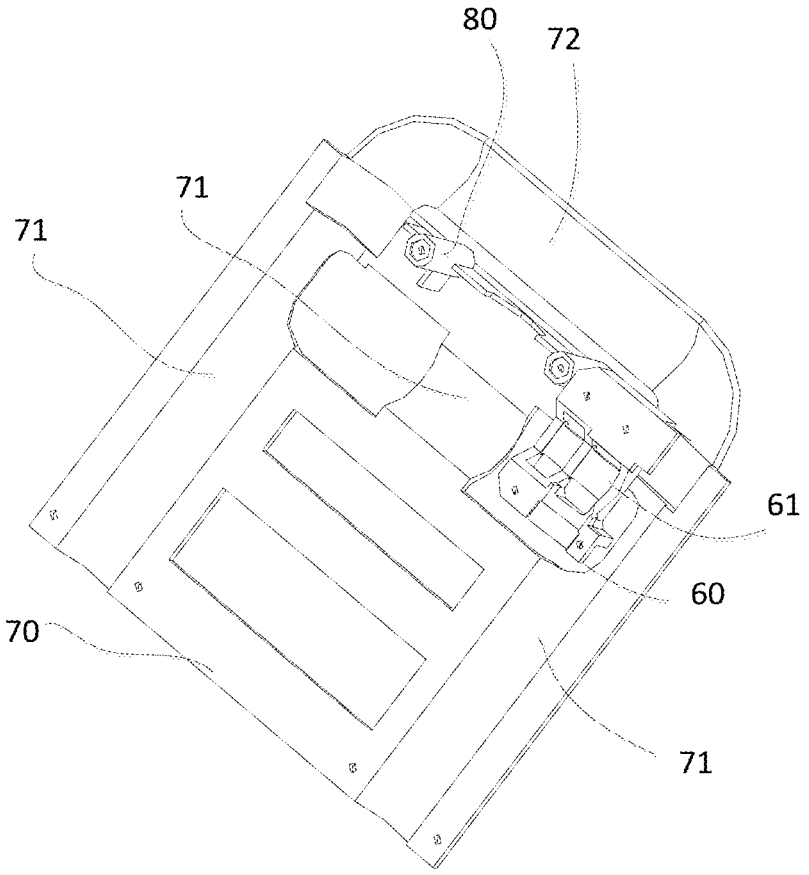
FIG. 4 is a front view of the bottom plate and the fixing plate of the embodiment shown in FIG. 1.
Figure 5:
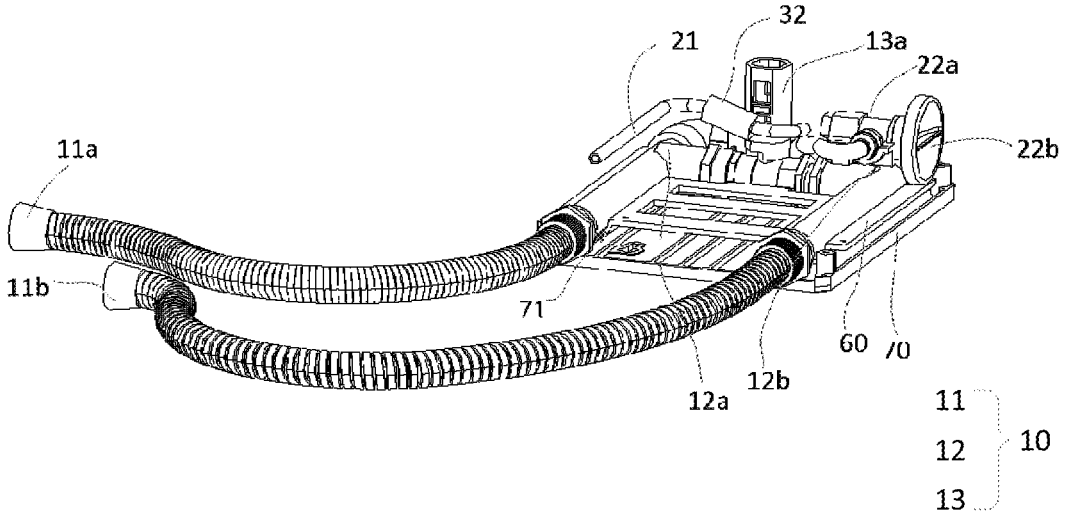
FIG. 5 is a perspective view of the assembly of the bottom plate, the pipe assembly and the valve body assembly of the embodiment shown in FIG. 1.

A device 100 for adding a fluid medium to a shower system according to an embodiment of the present application will be described below with reference to FIGS. 1-5.

The device 100 for adding a fluid medium to a shower system according to the embodiment of the present application includes: a water pipe assembly 10 which includes a water pipe 11 having a water inlet 11*a* and a water outlet 11*b*, the water inlet 11*a* and the water outlet 11*b* are configured to connect with the shower system; a fluid medium pipe assembly 20 which includes a suction pipe 21 having a fluid medium inlet 21*a* and a fluid medium outlet 21*b*, the fluid medium outlet 21*b* is connected with the water pipe assembly 10; and a valve body assembly 30 which includes a one-way valve 32 for preventing back flow of the liquid medium and a water jet pump 31, the one-way valve 32 is provided between the fluid medium inlet 21*a* and the fluid medium outlet 21*b*, The water jet pump 31 includes a three-way valve pipe. A water inlet pipe 31*a* of the three-way valve pipe is in communication with the water inlet 11*a*, a water return pipe 31*b* of the three-way valve pipe is in communication with the fluid medium outlet 21*b*, and a water mixing pipe 31*c* of the three-way valve pipe is in communication with the water outlet 11*b*.

Thereby, when the device 100 for adding a fluid medium to a shower system according to the embodiment of the present application is used by a user, a negative pressure is generated in the water inlet pipe 31*a* of the water jet pump 31 of the device of the present application, so as to control a fluid medium to be sucked from a fluid medium inlet 21*a* of the suction pipe 21 and flow into a water return pipe 31*b* of the water jet pump 31. The fluid medium is mixed with the water flowing into the water inlet pipe 31*a* of the water jet pump 31 in the water mixing pipe 31*c* of the water jet pump 31, and then flows into the shower system via the water outlet 11*b* to supply the fluid medium for the user. In the above operations, the fluid medium can be brought into contact the skin of the user without directly squeezing the bottle containing the fluid medium by hand.

In addition, the device 100 for adding a fluid medium to a shower system according to the embodiment of the present application can achieve at least some of the following effects.

Reliability is good. The device according to the embodiment of the present application is provided with a one-way valve 32 between the fluid medium inlet 21*a* and the fluid medium outlet 21*b*. Therefore, such device of the present application can prevent the fluid medium from flowing back and prevent water from flowing out of the fluid medium inlet 21*a* and in turn contaminating the fluid medium.

The versatility is good. The device according to the embodiment of the present application can be directly installed in the existing shower system, which can easily and quickly solve the cumbersome cleaning work of the user.

It is understood for those skilled in the art that the fluid medium used by people when showering includes perfume, soapy water, shampoo, shower gel or other skin care products in form of fluid.

The device according to the embodiment of the present application can be used in any shower system, such as a shower system with a shower room, a shower at a floor level, a large-capacity shower, or the like. The device according to the embodiment of the present application can also be integrated into a bathtub.

In some specific examples of the present application, the three-way valve pipe includes a venturi nozzle. The water inlet pipe 31*a*, the water return pipe 31*b* and the water mixing pipe 31*c* meet at a center (not shown), and the venturi nozzle is provided between the water inlet pipe 31*a* and the center. The venturi nozzle has a continuously reduced cross-sectional area of a flow channel, which can form a low pressure in the water inlet pipe 31*a*, thereby sucking the fluid medium transported and mixing it with water in the water mixing pipe 31*c*. The device according to the embodiments of the present application has a strong self-suction capability and can reliably suck the fluid medium into the water pipe 11.

In some specific examples of the present application, the three-way valve pipe is a venturi three-way valve pipe. The venturi three-way valve pipe has a venturi nozzle that continuously reduces a cross-sectional area of a flow channel and a venturi diffusion chamber that continuously increases the cross-sectional area of the flow channel (the venturi diffusion chamber is located between the center and the water outlet 11*b*). Therefore, the device according to the embodiments of the present application has a better self-suction capability. In addition, the venturi diffusion chamber is relatively insensitive to the impurities, and thus is especially suitable as a discharge pipe for the mixed liquid after the fluid medium is mixed with water.

In some specific examples of the present application, the fluid medium pipe assembly 20 includes a venturi switch 22, and the venturi switch 22 is provided between the fluid medium inlet 21*a* and the water return pipe 31*b*. The venturi switch 22 may be used to control the opening and closing of the valve body assembly 30, thereby meeting the needs of a user to start or stop using the mixed liquid after the fluid medium is mixed with water.

In some specific examples of the present application, the device includes a box body 40. The fluid medium pipe assembly 20 and the valve body assembly 30 are disposed in the box body 40. The box body 40 is designed to protect the fluid medium pipe assembly and the valve body assembly 30 from being damaged by external forces and also for aesthetics.

In some specific examples of the present application, the device includes the box body 40 and a fixing plate 60. The fixing plate 60 has a first groove portion 61. The venturi switch 22 includes a first activation element 22*a*, and the first activation element 22*a* is disposed in the first groove portion 61 and faces a left side face or a right side face of the box body 40. When the device according to the embodiments of the present application is hung on a wall with a height of about 1.5 meters from the ground, the activation element of the venturi switch 22 is arranged on the side face of the box body 40, conforming to human mechanics.

Those skilled in the art can understand that when the device according to the embodiments of the present application is hung on a wall with a height of about 0.5 meters from the ground, the activation element of the venturi switch 22 is arranged on the top face of the box body 40, conforming to human mechanics In some specific examples of the present application, the venturi switch 22 further includes a first switching element (not shown) and a first rotary knob 22*b*. The first rotary knob 22*b* is connected to the first activation element 22*a*, and the first rotary knob 22*b* protrudes from the box body 40 to facilitate the user operation.

In some specific examples of the present application, the water pipe assembly 10 includes a bypass pipe 12. A water inlet end 12*a* of the bypass pipe 12 is in communication with the water inlet 11*a* and the water inlet pipe 31*a* respectively, and a water outlet end 12*b* of the bypass pipe 12 is in communication with the water outlet 11*b* and the water mixing pipe 31*c* respectively. The design of the bypass pipe 12 can enhance the injection effect of the water jet pump 31. The device of the embodiments of the present application can stably and reliably provide the fluid medium to the user.

Before the inventors designed a water pipe assembly 10 provided by the embodiments of the present application to include a bypass pipe 12, the device provided the embodiments of the present application is difficult to reliably supply the fluid medium to the user when the water jet pump 31 is damaged or the user's home water pressure is insufficient. In order to solve the above-mentioned problem, the inventors herein have designed a device 100 for adding a fluid medium to a shower system including a bypass pipe 12 in an embodiment of the present application.

In some specific examples of the present application, the water pipe assembly 10 includes a flow regulator 13, and the flow regulator 13 is provided between the water inlet end 12*a* of the bypass pipe 12 and the water outlet end 12*b* of the bypass pipe 12. The flow regulator 13 is designed to control the strength of the injection effect of the water jet pump 31, so that the device of the embodiment of the present application can stably and reliably supply the fluid medium for the user.

In some specific examples of the present application, the flow regulator 13 further includes a second activation element 13*a*, a second switching element (not shown), and a second rotary knob 13*b*. The second activation element 13*a* is connected to the second rotary knob 13*b*, and the second rotary knob 13*b* protrudes from the box body 40 to facilitate the user operation.

In some specific examples of the present application, the second rotary knob 13*b* is provided on the front of the box body 40, conforming to human mechanics.

In some specific examples of the present application, the bottom of the box body 40 is provided with a reservoir 50 for storing the fluid medium. The suction pipe 21 is extends into the reservoir 50. When the user uses the device according to the embodiment of the present application, the negative pressure is generated in the water inlet pipe 31*a* of the water jet pump 31, thereby sucking the fluid medium in the reservoir 50 via the fluid medium inlet 21*a* of the suction pipe 21.

In some specific examples of the present application, the box body 40 is detachably connected with the reservoir 50. This design is convenient for the user to place the fluid medium in the reservoir 50.

In some specific examples of the present application, the bottom of the box body 40 is provided with a through hole 41*a*, and the reservoir 50 is provided with a protrusion 51 that is plug-fitted with the through hole 41*a*. The installation and removal of the box body 40 and the reservoir 50 may be achieved by pulling and pushing.

In some specific examples of the present application, the suction pipe 21 is a flexible pipe. This design facilitates the installation and removal of the box body 40 and the reservoir 50.

In some specific examples of the present application, the device includes a bottom plate 70. The bottom plate 70 is provided with a second groove portion 71 and a third groove portion 72, the water pipe 11 is disposed in the second groove portion 71, and the water jet pump 31 is disposed in the third groove portion 72. The design of the second groove portion 71 and the third groove portion 72 on the bottom plate 70 facilitates the installation and fixing of the water pipe 11 and the water jet pump 31, and the device according to the embodiments of the present application will not scatter during the transportation and use.

In some specific examples of the present application, the box body 40 includes a box cover 41 and a box bottom 42. The box cover 41 and the box bottom 42 are connected by a screw and/or a buckle. The bottom face of the box bottom 42 has a through hole for hanging on the wall. The bottom plate 70 is fixedly connected to the box bottom 42. The fixing plate 60 is provided on the bottom plate 70.

In some specific examples of the present application, the device includes a connecting plate 80 fixedly connected to the bottom plate 70. The connecting plate 80 is provided with a screw hole for connection with a screw of the box cover 41.

In some specific examples of the present application, the fluid medium includes one or more fragrance media. Those skilled in the art can understand that the fluid medium used by people when showering includes perfume, soapy water, shampoo, shower gel or other skin care products in form of fluid.

A shower system according to an embodiment of the present application, includes a showerhead (not shown) and a water source connector for introducing water. A water inter (not shown) of the showerhead is in communication with a water outlet (not shown) of the water source connector. The shower system further includes the device 100 for adding a fluid medium to the shower system as described above. The water outlet of the water source connector is further in communication with the water inlet 11*a*, and the water inter of the showerhead is further in communication with the water outlet 11*b*.

The shower system according to the embodiment of the present application enables the user to control the supply of the fluid medium easily while showering. In addition, the shower system according to the embodiment of the present application has other advantages as described for the above device 100 for adding a fluid medium to a shower system, which will not be repeated here.

In some specific examples of the present application, the system further includes a four-way valve pipe (not shown) having a first water inlet, a first water outlet, a second water inlet and a second water outlet. The first water inlet is in communication with the water outlet of the water source connector, the first water outlet is in communication with the water inlet 11*a*, the second water inlet is in communication with the water outlet 11*b*, and the second water outlet is in communication with the water inlet of the showerhead. When the user does not need the fluid medium, water reaches the user in two branches in which the first branch of water flows through the first water inlet and the second water outlet, and the second branch of water flows through the first water inlet, the first water outlet, the second water inlet and the second water outlet. As such, the supply of the fluid medium is stopped through controlling the venturi switch 22 by the user. When the user needs the fluid medium, water reaches the user through the first water inlet and the second water outlet, and the mixture of the liquid medium and water reaches the user through the second water inlet and the second water outlet.

In the description of the present application, it is should be understood that terms "first", "second", and "third" are only used for the purpose of description, but are not intended to indicate or imply the relative importance or implicitly indicate the number of technical features indicated. Therefore, a feature defined by "first", "second" and "third" may explicitly or implicitly includes one or more such features. In the description of the present application, the term "a plurality of" indicates two and more, unless expressly specified otherwise.

In the description of the present application, reference to "an embodiment", "some embodiments", "an example", "specific examples" or "some examples" herein means that the specific feature, structure, or characteristic described in conjunction with the embodiments or examples may be included in at least one embodiment or example of the present application. In this description, the schematic representations of the above terms do not necessarily refer to the same embodiment or example. Moreover, the described specific features, structures, materials or characteristics can be combined in any one or more embodiments or examples in a suitable manner. In addition, those skilled in the art may combine the different embodiments or examples and the features of the different embodiments or examples described in this specification when they are not mutually contradict.

Although the embodiments of the present application have been shown and described, those of ordinary skill in the art may understand that various changes, modifications, substitutions and variations may be made to these embodiments without departing from the principle and spirit of the present application. The scope of the present application is defined by the claims and their equivalents.

The invention claimed is:

1. A device for adding a fluid medium to a shower system, comprising:

a water pipe assembly comprising a water pipe, wherein the water pipe has a water inlet and a water outlet, and the water inlet and the water outlet are configured to connect with the shower system;

a fluid medium pipe assembly comprising a suction pipe, wherein the suction pipe has a fluid medium inlet and a fluid medium outlet, and the fluid medium outlet is connected with the water pipe assembly; and a valve body assembly comprising a one-way valve for preventing back flow of the liquid fluid medium and a water jet pump, wherein the one-way valve is provided between the fluid medium inlet and the fluid medium outlet, the water jet pump comprises a three-way valve pipe, a water inlet pipe of the three-way valve pipe is in communication with the water inlet, a water return pipe of the three-way valve pipe is in communication with the fluid medium outlet, and a water mixing pipe of the three-way valve pipe is in communication with the water outlet, wherein the three-way valve pipe comprises a venturi nozzle; the water inlet pipe, the water return pipe and the water mixing pipe meet at a center, and the venturi nozzle is provided between the water inlet pipe and the center, wherein the water pipe assembly comprises a bypass pipe; a water inlet end of the bypass pipe is in communication with the water inlet and the water inlet pipe respectively, and a water outlet end of the bypass pipe is in communication with the water outlet and the water mixing pipe respectively, and wherein the water pipe assembly comprises a flow regulator, and the flow regulator is in a form of a tube having two opposite ends; one of the two opposite ends is connected to the water inlet end of the bypass pipe, and the other of the two opposite ends is connected to the water outlet end of the bypass pipe.

2. The device for adding a fluid medium to a shower system according to claim 1, wherein the three-way valve pipe is a venturi three-way valve pipe.

3. The device for adding a fluid medium to a shower system according to claim 2, wherein the fluid medium pipe assembly comprises a venturi switch, and the venturi switch is provided between the fluid medium inlet and the water return pipe.

4. The device for adding a fluid medium to a shower system according to claim 1, wherein the fluid medium pipe assembly comprises a venturi switch, and the venturi switch is provided between the fluid medium inlet and the water return pipe.

5. The device for adding a fluid medium to a shower system according to claim 1, wherein the device comprises a box body, and the fluid medium pipe assembly and the valve body assembly are disposed in the box body.

6. The device for adding a fluid medium to a shower system according to claim 5, wherein a bottom of the box body is provided with a reservoir for storing the fluid medium, and the suction pipe extends into the reservoir; and the box body is detachably connected to the reservoir.

7. The device for adding a fluid medium to a shower system according to claim 6, wherein the bottom of the box body is provided with a through hole, and the reservoir is provided with a protrusion that is plug-fitted with the through hole.

8. The device for adding a fluid medium to a shower system according to claim 5, wherein the fluid medium pipe assembly comprises a venturi switch, and the venturi switch is connected between the fluid medium inlet and the water return pipe, and wherein the device comprises a fixing plate having a first groove portion, the venturi switch comprises a first activation element, and the first activation element is disposed in the first groove portion and faces a left side face or a right side face of the box body.

9. The device for adding a fluid medium to a shower system according to claim 5, wherein the device comprises a bottom plate, wherein the bottom plate is provided with a second groove portion and a third groove portion, the water pipe is disposed in the second groove portion, and the water jet pump is disposed in the third groove portion.

10. The device for adding a fluid medium to a shower system according to claim 1, wherein the fluid medium comprises one or more fragrance media; or the suction pipe is a flexible pipe.

11. A shower system, comprising a showerhead and a water source connector for introducing water, wherein a water inlet of the showerhead is in communication with a water outlet of the water source connector, and wherein the shower system further comprises a device for adding a fluid medium to the shower system the device for adding a fluid medium to the shower system comprising:

a water pipe assembly comprising a water pipe, wherein the water pipe has a water inlet and a water outlet, and the water inlet and the water outlet are configured to connect with the shower system;

a fluid medium pipe assembly comprising a suction pipe, wherein the suction pipe has a fluid medium inlet and a fluid medium outlet, and the fluid medium outlet is connected with the water pipe assembly; and a valve body assembly comprising a one-way valve for preventing back flow of the fluid medium and a water jet pump, wherein the one-way valve is provided between the fluid medium inlet and the fluid medium outlet, the water jet pump comprises a three-way valve pipe, a water inlet pipe of the three-way valve pipe is in communication with the water inlet, a water return pipe of the three-way valve pipe is in communication with the fluid medium outlet, and a water mixing pipe of the three-way valve pipe is in communication with the water outlet, wherein the water outlet of the water source connector is further in communication with the water inlet, and the water inlet of the shower head is further in communication with the water outlet, wherein the three-way valve pipe comprises a venturi nozzle; the water inlet pipe, the water return pipe and the water mixing pipe meet at a center, and the venturi nozzle is provided between the water inlet pipe and the center, wherein the water pipe assembly comprises a bypass pipe; a water inlet end of the bypass pipe is in communication with the water inlet and the water inlet pipe respectively, and a water outlet end of the bypass pipe is in communication with the water outlet and the water mixing pipe respectively, and wherein the water pipe assembly comprises a flow regulator, and the flow regulator is in a form of a tube having two opposite ends; one of the two opposite ends is connected to the water inlet end of the bypass pipe, and the other of the two opposite ends is connected to the water outlet end of the bypass pipe.

* * * * *